US008393843B2

(12) United States Patent
Blohm et al.

(10) Patent No.: US 8,393,843 B2
(45) Date of Patent: Mar. 12, 2013

(54) PRINTED PRODUCT BINDING METHOD

(75) Inventors: Eric E. Blohm, West Allis, WI (US); Paul Volz, Hubertus, WI (US); Ken Frohmader, West Bend, WI (US)

(73) Assignee: Quad/Graphics, Inc., Sussex, WI (US)

( * ) Notice: Subject to any disclaimer, the term of this patent is extended or adjusted under 35 U.S.C. 154(b) by 2676 days.

(21) Appl. No.: 10/607,233

(22) Filed: Jun. 26, 2003

(65) Prior Publication Data

US 2004/0265095 A1 Dec. 30, 2004

(51) Int. Cl.

| | |
|---|---|
| ***B65H 39/02*** | (2006.01) |
| *B42B 2/02* | (2006.01) |
| *B42C 11/00* | (2006.01) |

(52) U.S. Cl. ..... 412/1; 412/3; 412/18; 270/52.03; 270/52.05; 270/1.02

(58) Field of Classification Search ..... 270/52.03, 270/52.04, 52.05, 1.01, 1.02, 1.03; 412/1, 412/3, 9, 17, 18

See application file for complete search history.

(56) References Cited

U.S. PATENT DOCUMENTS

| | | | | |
|---|---|---|---|---|
| 3,819,173 | A * | 6/1974 | Anderson et al. | 270/52.04 |
| 3,917,252 | A * | 11/1975 | Harder et al. | 270/52.05 |
| 4,395,031 | A * | 7/1983 | Gruber et al. | 270/52.29 |
| 5,114,128 | A * | 5/1992 | Harris et al. | 270/1.03 |
| 5,428,423 | A * | 6/1995 | Clark | 355/77 |
| 5,713,605 | A * | 2/1998 | Pace et al. | 281/38 |
| 6,347,260 | B1 * | 2/2002 | Graushar et al. | 700/223 |
| 6,400,659 | B1 * | 6/2002 | Kitaoka | 369/34.01 |
| 6,694,219 | B2 * | 2/2004 | Graushar et al. | 700/223 |

* cited by examiner

*Primary Examiner* — Dana Ross
*Assistant Examiner* — Pradeep C Battula
(74) *Attorney, Agent, or Firm* — Michael Best & Friedrich LLP

(57) ABSTRACT

The invention relates to a method for replacing a rejected book on a binding line.

14 Claims, 6 Drawing Sheets

PRINTED PRODUCT BINDING METHOD

FIELD OF THE INVENTION

The present invention relates to binding of printed media, and more particularly, to the replacement of rejected printed media.

BACKGROUND OF THE INVENTION

"Book" as used herein refers to books, magazines, catalogs, pamphlets, envelopes, poly and paper packages and other printed materials. Books are typically assembled through either conventional saddle stitch or perfect binding processes and it should be noted that the present invention may be used in conjunction with saddle stitch, perfect binding, paper/poly packaging and other binding methods.

Printers commonly customize books by including particular signatures within the book based on known characteristics of the recipient. This type of customization is known in the printing industry as selective binding. Selective binding is done by selectively placing designated signatures that are stored in feeders along a binding line onto the binding line such that books are assembled using a particular set of designated signatures based on a recipient's profile. Customization can also occur through the feeding and binding of a CD, onsert, insert or the like into a book in a process known as selective inserting/onserting.

Printers also produce individual books with unique personalized information, graphics or indicia relating to the book's intended recipient. One of the more common ways to personalize a book is to have the recipient's identity and address information printed on the cover of the book once the book is assembled. Another method of personalizing books relates to printing personalized indicia onto one or more signatures before the signatures are assembled into respective books. Signatures can be personalized while they are on the binding line by using an ink jet printer positioned near the binding line. As the signatures pass the ink jet printer, personalized information or indicia is printed onto one or more of the signatures. Signatures may also be pre-personalized (i.e., in a separate or off-line printing process) prior to being fed onto the binding line.

A bound book can be rejected from the binding line for various reasons as are known in the art, i.e., improper signature feed, multiple signature feed, etc. If a rejected book is personalized or contains pre-personalized indicia, the process of regenerating an identical pre-personalized book for the particular recipient is more difficult.

SUMMARY OF THE INVENTION

There is a need for providing a recipient with an alternate piece of printed or electronic media in place of a pre-personalized book that is rejected during the binding process.

The present invention provides a binding method including generating a pre-personalized book on a binding line for a specific individual, rejecting selective pre-personalized books, and generating an alternate piece in place of the rejected pre-personalized book to be delivered to the specific individual.

The present invention provides a binding method including generating a mailing list of recipients, generating a pre-personalized book for each recipient on the binding line, rejecting selective pre-personalized books, identifying the recipient of each rejected pre-personalized book, and generating an alternate piece for each rejected pre-personalized book.

The present invention provides a method of replacing a rejected book on a binding line including generating a mailing list of recipients having a mailing order, assembling a pre-personalized book on the binding line for each recipient according to the mailing list, rejecting selective pre-personalized books, and generating an alternate piece on the binding line to replace the rejected pre-personalized book, the alternate piece positioned on the binding line to maintain the mailing order.

The present invention provides a binding method including generating a mailing list of recipients, generating a pre-personalized printed product off-line for selected recipients on the mailing list, loading the pre-personalized printed products adjacent the binding line, assembling a book for each recipient including a respective pre-personalized printed product, rejecting a selected recipients book, and generating an alternate piece for each rejected book.

The present invention provides a binding method including generating a pre-personalized book on a binding line for a specific individual, the book having therein a portion containing pre-personalized information, rejecting selective pre-personalized books, reprinting the portion of each rejected book, then regenerating the pre-personalized book on the binding line for the specific individual to include the portion.

The present invention provides a binding method including generating a mailing list of recipients, generating a pre-personalized printed product for each recipient, assembling a first book on the binding line for each recipient, said assembly including a respective pre-personalized piece, rejecting selective first books, reprinting the pre-personalized printed product for each recipient whose first book was rejected, then assembling a second book on the binding line for each recipient whose first book was rejected, said assembly including the reprinted pre-personalized printed product.

The present invention includes a method of replacing a rejected book on a binding line including generating a mailing list of recipients, assembling a pre-personalized book on the binding line for each recipient, rejecting selected pre-personalized books, and replacing each rejected book with a generic book, a regenerated second book identical to the rejected book, or an alternate piece.

DETAILED DESCRIPTION

Figure 1:
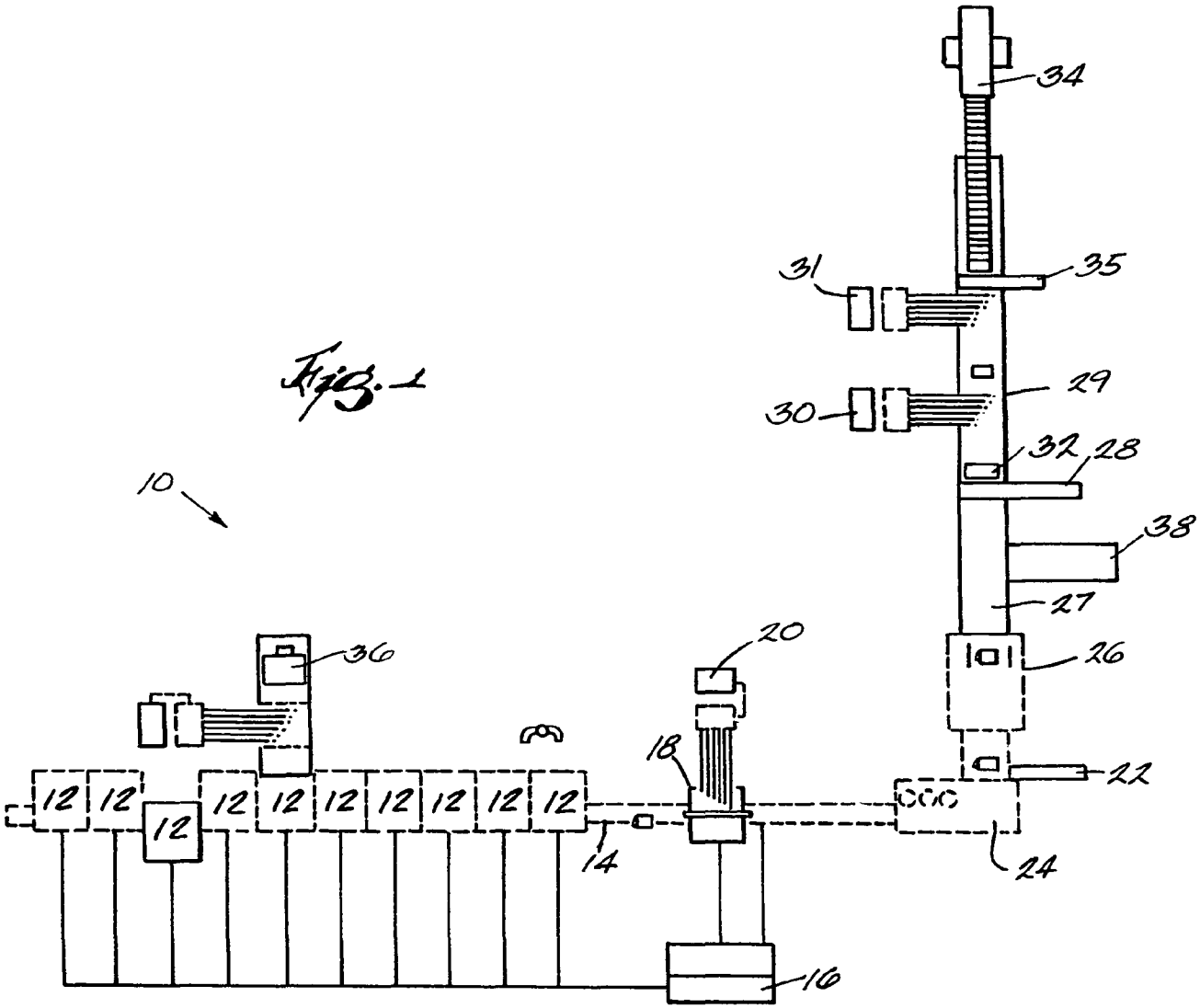
FIG. 1 is a plan view of a binding line for producing pre-personalized books.

FIG. 1 illustrates a binding line 10 for assembling books. The binding line 10 includes a plurality of feeders 12 and a conveyor line 14. The feeders 12 contain signatures, CDs, other electronic media, onserts, inserts, etc. that will comprise a book. Signature as used herein generically refers to printed pages. Although ten feeders are shown delivering product to the conveyor line 14, it should be understood that binding lines may include additional or less feeders. In addition, any feeder 12 that is well known in the art can be used as part of the binding line 10 without departing from the scope of the present invention.

One or more of the feeders 12 feeds pre-personalized pieces to the binding line 10. The pre-personalized pieces may be a signature, a product insertable into a book such as a postcard, a pamphlet, bank checks, coupons, a special-interest publication, or a type of electronic media. The pre-personalized piece may include a readable code such as a bar code or OCR digits as a verification to ensure that the pre-personalized piece is being bound into the correct recipient's book and/or as a driver to control assembly of the books.

The binding line 10 includes a controller 16, as is known in the art, that maintains a master mailing list having a prearranged sequence or order, such as, for example, a zip code order. The controller 16 controls the feeders 12 to assemble each book according to the mailing list information. The controller 16 monitors the position of each book as it is being assembled on the conveyor 14 and tracks the position of each book as it moves downstream of the feeders 12.

The binding line 10 includes a station 18 downstream of the feeders 12. The station 18 includes an ink jet printer 20 that optionally prints personalized indicia, i.e., recipient name and address, on the cover or in the interior of the book. Each book is inspected at the station 18 by a caliper or other sensor to detect the thickness or print quality of the book. This information is transmitted to the controller 16, which compares the measured thickness or print quality with a reference thickness or print quality, in order to determine if the book has been appropriately assembled. If an error was made in the assembly of the book, the book is rejected from the binding line 10 at a divert gate 22.

Downstream of the station 18, the binding line 10 includes a stitcher 24, where the books are bound, i.e., stapled, glued, stitched, and fastened. The binding line 10 further includes the divert gate 22, a trimming station 26, where the edges of each book are trimmed, a first mail table 27, a printer and feeder 38, a second divert gate 28, a shuttle hopper 32, a second mail table 29 and a third divert gate 35. The mail table 29 includes ink-jet printers 30, 31 where additional personalization indicia is optionally printed on the book cover, any cover wrap, the pre-personalized piece, or inside the book. The controller 16 directs the printers 30, 31 to print the personalized indicia at the appropriate location. The binding line 10 ends with a stacker 34 downstream of the mail table 29. The stacker 34 bundles together books that are being delivered to a common zip code, or other predetermined order, for handling by the U.S. Postal Service or other postal service.

Figure 2:
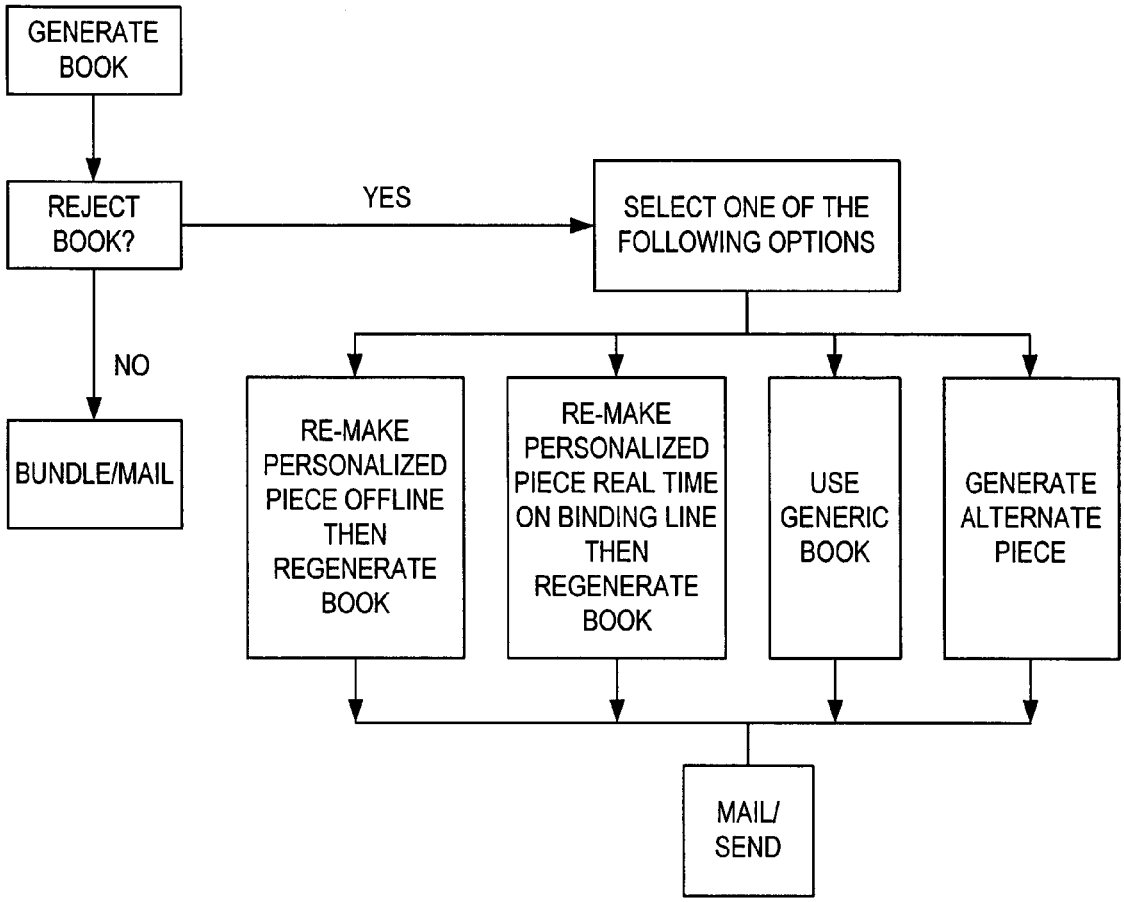
FIG. 2 is a flow chart of options if a book is rejected.

When a book is rejected as unacceptable and removed from the binding line 10 at either divert gate 22, 28 or 35, the controller 16 identifies the recipient of the rejected book and preferably one or more of the following four options, as shown in FIG. 2, is performed.

With respect to a first option, the names of all the recipients who had rejected books are accumulated. The pre-personalized pieces for only those recipients are then reproduced off-line. The pre-personalized pieces are then loaded onto the binding line 10 or a similar binding line and the books for this smaller set of recipients are then made again and mailed accordingly.

In a second option, a printer 36, such as a print-on-demand laser printer, which is associated with one of the printed feeders 12, reprints the pre-personalized piece for the recipient whose book was rejected, and preferably reprints the pre-personalized piece as soon as possible after the book was rejected. The pre-personalized piece is folded, if necessary, and fed to the binding line 10 and the book for that particular recipient is rebound as before.

In a third option, a generic book is loaded on the binding line 10 at the shuttle hopper 32 in place of and in the same order as any book that was rejected. The generic book would therefore not include the pre-personalized piece.

In a fourth option, an alternate piece is generated. The alternate piece may be generated on the same binding line, on a different binding line or in an off-line process. Depending on the binding line arrangement, the alternate piece may be generated in real-time and inserted within the original stream of books or may be generated at a later time and mailed or electronically sent separately. The alternate piece 40 is of a format different from the pre-personalized piece.

Figure 3:
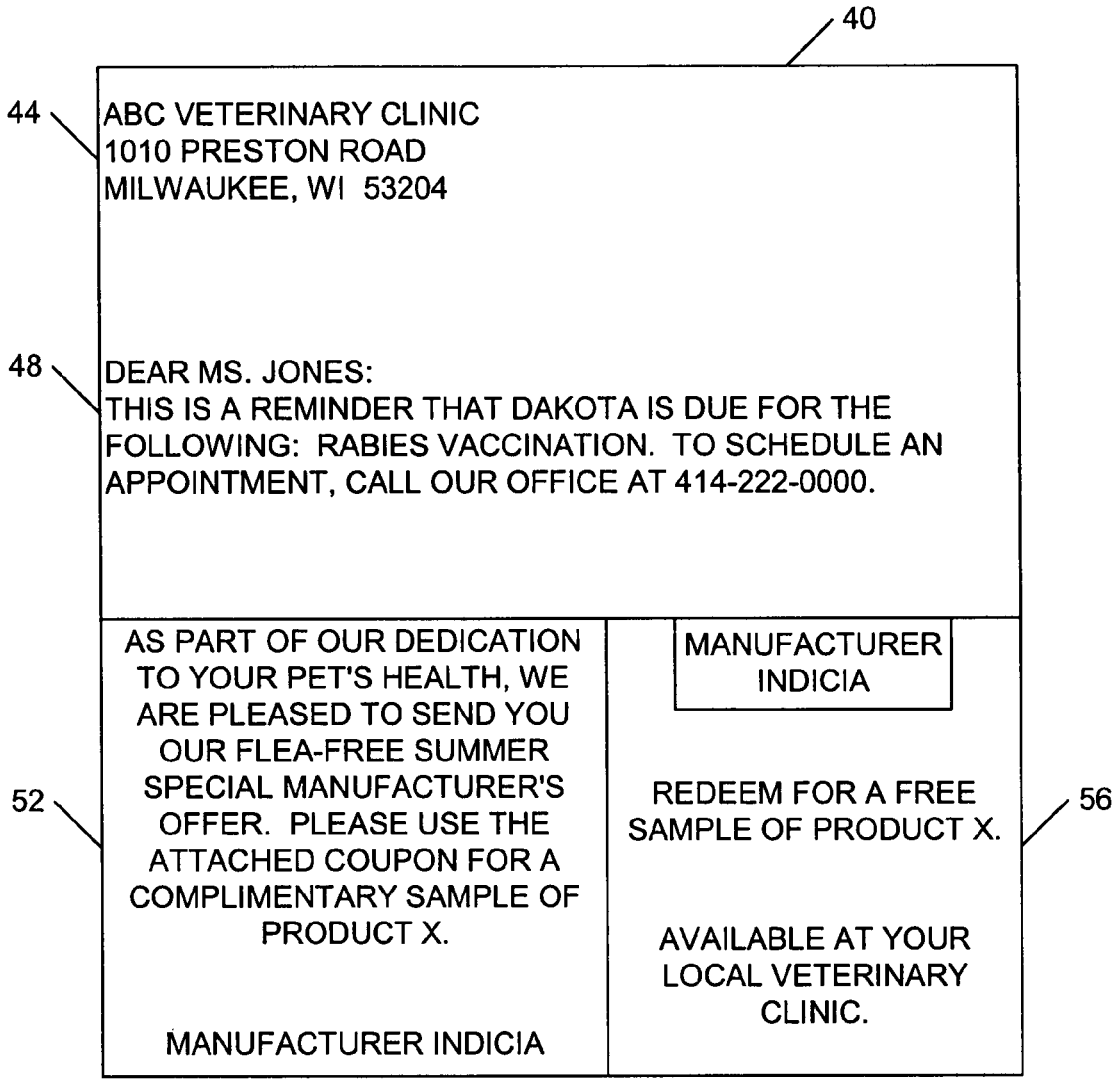
FIG. 3 is an exemplary illustration of an alternate piece to replace a rejected book.

FIG. 3 illustrates an exemplary alternate piece 40. It should be noted that the illustrated alternate piece 40 is not limited to the content, size, and format shown. The alternate piece 40 may be in the form of a postcard, a book, a special-interest publication or other printed media or in the form of electronic media such as a CD, e-mail message, magnetic tape, or the like. The alternate piece 40 can include sender information 44, i.e., return address indicia, pre-personalized indicia 48, and more preferably, the same or similar pre-personalized information that was included in the rejected book, advertisement indicia 52, and/or promotional offer indicia 56.

Figure 4:
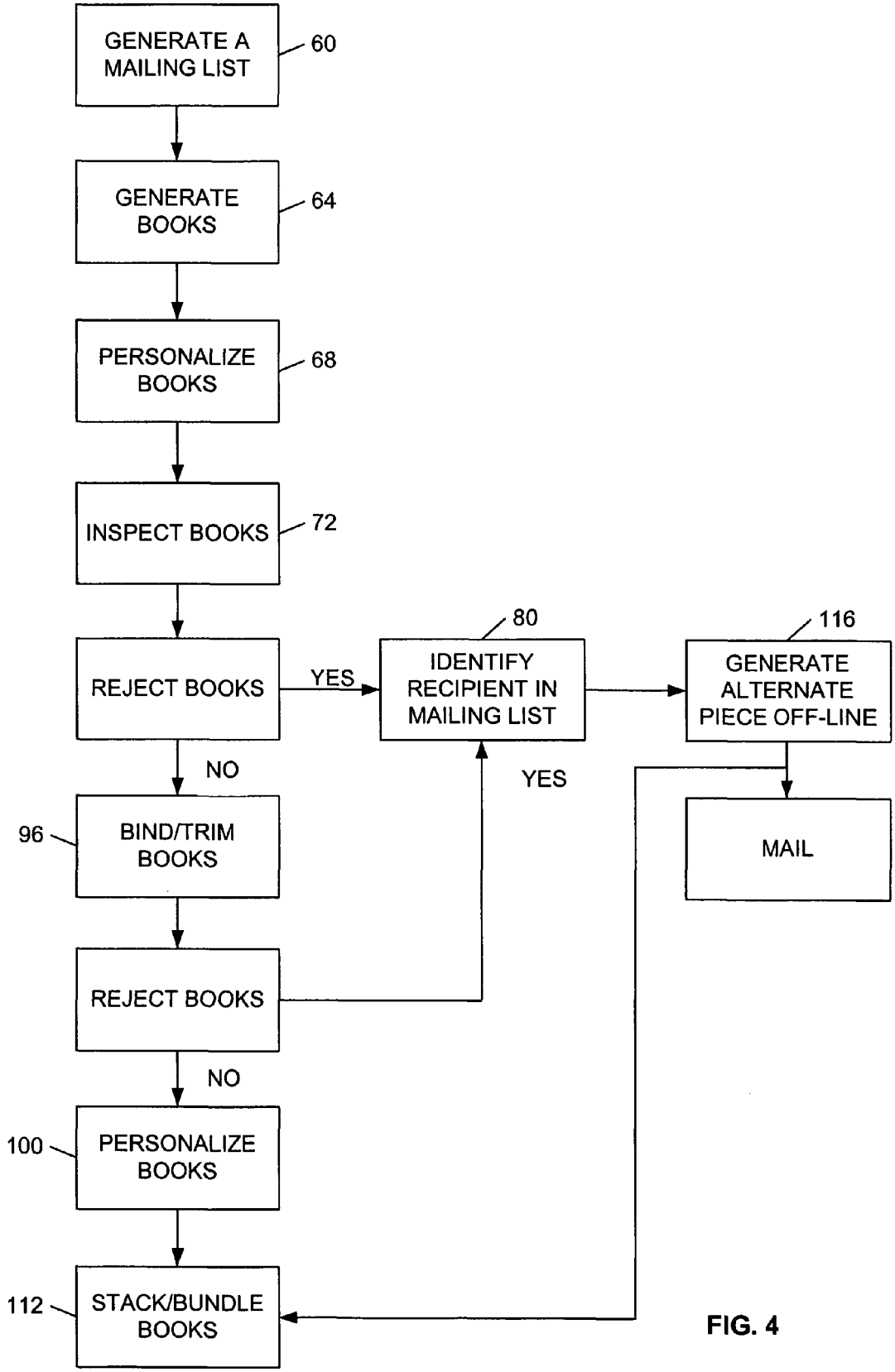
FIG. 4 is a flow chart illustrating a binding method.

One embodiment of the alternate piece option is illustrated in the exemplary flow chart of FIG. 4. A mailing list having a predetermined order is generated at step 60. Based on the mailing list, the controller controls the feeders to generate individual books at step 64 which include a pre-personalized piece fed from one of the feeders. Alternatively, the controller controls the feeders based upon the code read from a pre-personalized piece on a feeder. The feeders operate to selectively feed associated signatures to the conveyor line to assemble customized or demographic versions of a single publication.

At step 68, each book may be further personalized. A printer may print address information, targeted promotional offer indicia, reminders, coupons, etc. on the book covers and/or inside the book. The book is inspected, illustrated at step 72. If the book is unacceptable, it is rejected. The controller 16 identifies the recipient of the rejected book in the mailing list at step 80 and preferably maintains a space in the stream of books where each unacceptable book was rejected. Each acceptable book may be further personalized by printers 30 and 31, as illustrated at step 100. At step 112, the acceptable books are stacked and preferably bundled in the predetermined order to obtain optimal postal discounts.

The recipients of the rejected books are identified in the mailing list and stored in the controller. In an off-line process, illustrated at step 116, a printer generates an alternate piece 40, i.e., a postcard, bank checks, coupons, a book, or other printed media or an alternate piece 40 in electronic format is generated for the recipient. The alternate piece 40 preferably includes the same or similar pre-personalized information included in the new unusable pre-personalized piece for a given recipient. The alternate piece 40 may include information such as advertisement indicia, promotional offer indicia, appointment reminders, an indication that the recipient's book will be delayed, or an indication that the recipient's book will not be regenerated. In some situations, the recipient of the book may not be aware of the intended book because the book was a complimentary promotional book, and as such the recipient would not need to be informed that their book was rejected.

It should be noted that at some future time, the rejected book in its entirety may or may not be regenerated, depending upon on the time and costs of printing and mailing the book. In order to maintain optimal postal discounts, the alternate pieces 40 may be inserted by hand into the bundles of books at the stacker. Alternatively, the alternate pieces 40 may be bundled separately and delivered to the U.S. Postal Service.

Figure 5:
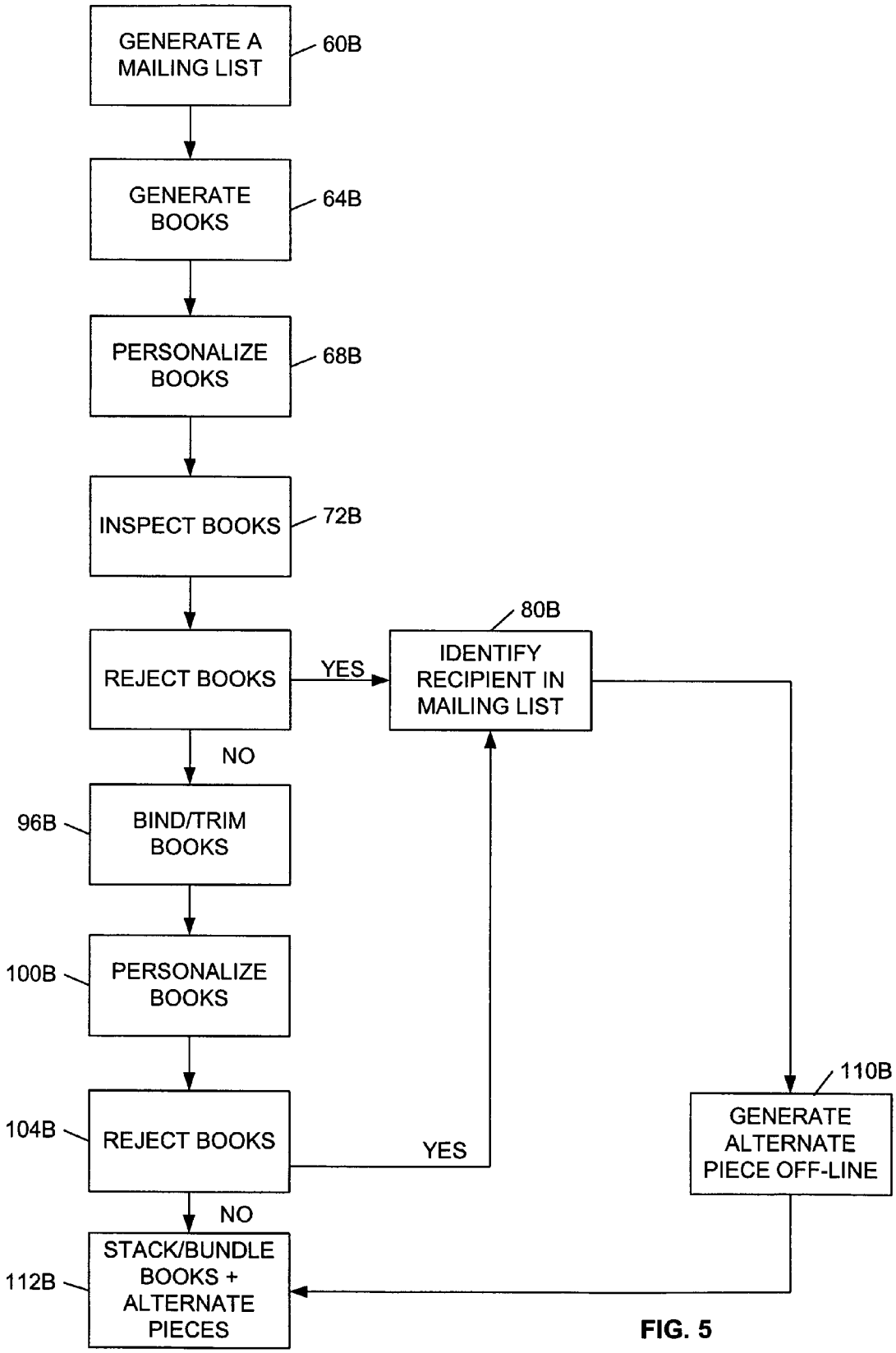
FIG. 5 is a flow chart illustrating a binding method.

Another embodiment of the alternate piece option is illustrated in the exemplary flow chart in FIG. 5. Common steps are identified by the same reference number with an appended "B". A stream of books including pre-personalized pieces is generated at step 64B based on the mailing list generated at step 60B. The books may be personalized as indicated by step 68B. The books are inspected at step 72B. If a book is rejected, the controller 16 identifies the recipient of the rejected book in the mailing list at step 80B. A space is preferably maintained in the stream of books.

The stream of books continues moving downstream to be stitched and trimmed at step 96B. At step 100B, the books may be further personalized. Unacceptable books are rejected at step 104B. The controller 16 identifies the recipient information of the rejected books at step 80B and an alternate piece is printed such as at the printer 38 (FIG. 1). The generated alternate piece 40 is inserted into the appropriate space in the stream of books, thereby maintaining the predetermined mailing order. The books and alternate pieces 40 proceed to be stacked and bundled together at step 112B to maintain optimal postal discounts.

Figure 6:
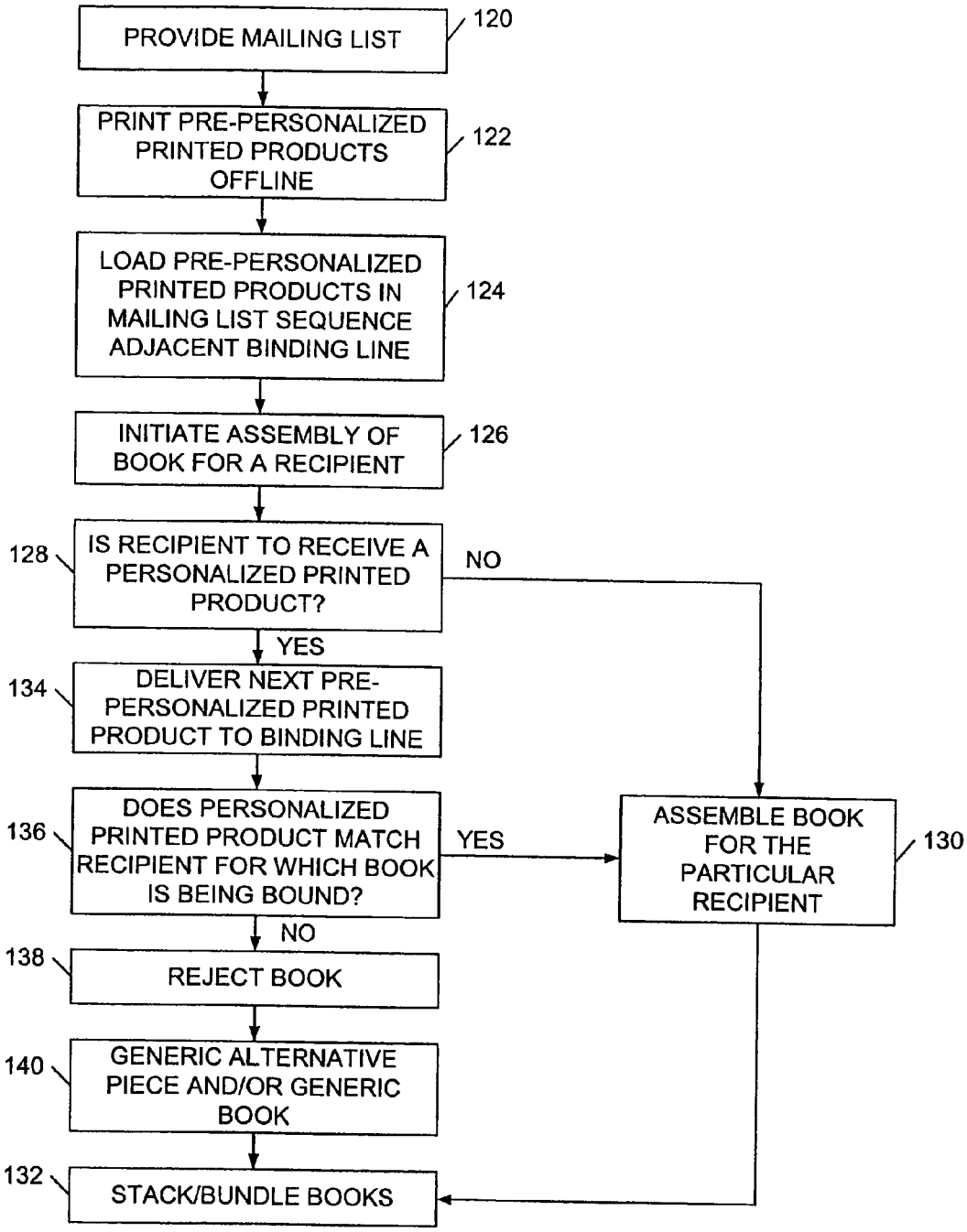
FIG. 6 is a flow chart illustrating a binding method.

Turning now to FIG. 6, an alternate embodiment of the present binding method is illustrated. In this embodiment, pre-personalized printed products are selectively bound for only a portion of the recipients on a mailing list. The mailing list is provided which indicates which of the recipients will receive a pre-personalized printed product (step 120). The pre-personalized printed products are generated off-line (step 122) and loaded adjacent a binding line in the order the recipients appear on the mailing list (step 124).

When the binding process is initiated (step 126), the controller 16 determines whether the recipient for which a book is next to be assembled and bound will be receiving one of the pre-personalized printed products (step 128). If not, a book is conventionally assembled (step 130) then conventionally stacked/bundled (step 132). If a recipient is to receive one of the pre-personalized printed products, the next in line pre-personalized piece is delivered to the binding line (step 134). A check then takes places to verify that the information on the pre-personalized printed product that was delivered to the binding line is for the same recipient for which the current book is being assembled (step 136). The verification can occur such as with the reading of a code on the pre-personalized printed product, with machine vision, or with any other verification method. If the pre-personalized printed product is a match to the recipient such that verification is confirmed, the book for that recipient is finished being assembled (step 130) and then stacked/bundled (step 132). If the pre-personalized printed product is not a match to the recipient, the book is rejected (step 138). At this point, either a generic book can be generated such as the books for the recipients on the mailing list that were not to receive the personalized printed products, an alternate piece can be generated as detailed above, or both could occur (step 140).

The present invention is not limited to the forms shown and described above. Alternate forms will be apparent to those skilled in the art and are within the intended scope of the present invention. The forms described herein are further intended to explain the best modes known for practicing the invention and to enable those skilled in the art to utilize the invention in such, or other, forms and with various modifications required by the particular applications or uses of the present invention. It is intended that the appended claims be construed to include alternate forms to the extent permitted by the prior art.

What is claimed is:

1. A binding method comprising:

generating a mailing list of recipients;

generating a pre-personalized book for each recipient on a binding line;

rejecting one of the pre-personalized books;

identifying the recipient of the rejected pre-personalized book; and generating an alternate piece that replaces the rejected pre-personalized book, wherein the alternate piece includes a notification to the recipient regarding the status of their pre-personalized book.

2. The method of claim 1 wherein the alternate piece is a printed product.

3. The method of claim 1 wherein the pre-personalized book includes pre-personalized information and the alternate piece includes the pre-personalized information.

4. The method of claim 1 wherein the act of generating the alternate piece includes printing the alternate piece on the binding line.

5. The method of claim 1 wherein the act of generating the alternate piece includes printing the alternate piece off-line with respect to the binding line.

6. The method of claim 1 wherein the alternate piece is in electronic format.

7. A binding method comprising:

generating a mailing list of recipients;

generating a pre-personalized printed product off-line for selected recipients on the mailing list;

loading the pre-personalized printed products adjacent a binding line;

assembling a book for each recipient including a respective pre-personalized printed product;

rejecting selective recipients' books;

removing the rejected books from the binding line; and generating an alternate piece in place of each rejected book, the alternate piece being of a different medium than the pre-personalized printed product.

8. The binding method of claim 7 wherein the alternate piece includes at least a portion of the pre-personalized information contained in the pre-personalized printed product for a given selected recipient.

9. The binding method of claim 7 and further including the act of generating a generic book to be sent to the selected recipients whose books, which were to include the pre-personalized printed products, were rejected.

10. A binding method comprising:

generating a pre-personalized book on a binding line for a plurality of specific individuals, each pre-personalized book having therein a pre-personalized signature;

rejecting selective pre-personalized books;

reprinting the pre-personalized signature of one of the rejected pre-personalized books; and regenerating the rejected pre-personalized book on the binding line for the specific individual to include the reprinted pre-personalized signature, wherein the step of reprinting the portion is done offline with respect to the binding line.

11. A binding method comprising:

generating a mailing list of recipients;

generating a pre-personalized printed product for each recipient;

assembling a book on a binding line for each recipient, each said book including the respective pre-personalized piece;

rejecting selective books;

removing the rejected books from respective spaces along the binding line;

generating an alternate pre-personalized piece for each recipient whose book was rejected, the alternate pre-personalized piece being of a different medium than the pre-personalized printed product; and inserting the alternate pre-personalized piece into the space previously occupied by the respective rejected book.

12. The binding method of claim 11 wherein generating the alternate pre-personalized piece is done on the binding line.

13. The binding method of claim 11 wherein generating the alternate pre-personalized piece is done off line with respect to the binding line.

14. A method of replacing a rejected book on a binding line, the method comprising:

generating a mailing list of recipients;

assembling a pre-personalized book on the binding line for each recipient;

rejecting selected pre-personalized books;

replacing a first rejected book with a generic book;

replacing a second rejected book with a regenerated second book identical to what the second rejected book should have been; and replacing a third rejected book with a different medium.

* * * * *